United States Patent [19]

Osburn

[11] 4,158,334

[45] Jun. 19, 1979

[54] SAFE/ARM FIRING DEVICE

[75] Inventor: Michael R. Osburn, Ridgecrest, Calif.

[73] Assignee: The United States of America as represented by the Secretary of the Navy, Washington, D.C.

[21] Appl. No.: 902,128

[22] Filed: May 2, 1978

[51] Int. Cl.[2] ..... F42C 15/10; F42C 15/32

[52] U.S. Cl. ..... 102/16; 102/229; 102/272

[58] Field of Search ..... 102/16, 223, 229, 272, 102/275

[56] References Cited

U.S. PATENT DOCUMENTS

| | | | |
|---|---|---|---|
| 2,795,189 | 6/1957 | Haberland | 102/16 |
| 2,980,020 | 4/1961 | Smith | 102/229 |
| 3,022,729 | 2/1962 | Robinson, Jr. | 102/16 |
| 3,095,815 | 7/1963 | Brockway et al. | 102/16 |
| 3,102,475 | 9/1963 | Beckwith, Jr. | 102/16 |
| 3,143,071 | 8/1964 | Arnold, Jr. et al. | 102/229 |
| 3,195,460 | 7/1965 | Kalaf | 102/16 |
| 3,362,333 | 1/1968 | Czajkowski et al. | 102/229 |
| 3,368,488 | 2/1968 | Johnson et al. | 102/229 |
| 3,391,639 | 7/1968 | Bochman, Jr. | 102/16 |
| 3,839,984 | 10/1974 | Hinves et al. | 102/16 |
| 3,853,056 | 12/1974 | Fisher | 102/16 |
| 3,889,598 | 6/1975 | Belsley | 102/16 |
| 3,951,036 | 4/1976 | Ramstad | 102/16 |

*Primary Examiner*—Charles T. Jordan
*Attorney, Agent, or Firm*—R. S. Sciascia; W. Thom Skeer; J. Lynn

[57] ABSTRACT

An out-of-line safe/arm device for initiating an explosive deep within a geothermal well which maintains the sensitive explosive elements thereof in an out-of-line position until armed by the pressures unique to the environment of the well.

6 Claims, 2 Drawing Figures

SAFE/ARM FIRING DEVICE

BACKGROUND OF THE INVENTION

1. Field of the Invention

The present invention relates to an out-of-line safe/-arm mechanism which is self-armed at a predetermined ambient pressure and is self-actuated at another predetermined greater ambient pressure.

2. Description of Prior Art

Two examples of Prior Art which involve self-armed and actuated devices are U.S. Pat. Nos. 3,102,475 and 3,143,071. Both of the referenced U.S. Patents. relate to explosive devices for use underwater wherein an out-of-line safe/arm device is moved into an in-line position under the influence of outside hydrostatic pressure and then detonated by a percussion device which is also actuated under the influence of outside hydrostatic pressure.

In the case of the device disclosed in U.S. Pat. No. 3,102,475, a slider 38 is caused to move axially within a passage 32. The slider carries a detonator 44 therein. Under influence of outside pressure, the slider is caused to move axially until the detonator 44 lines up with a firing pin 82 and a booster charge 16.

A Belleville-type spring 74 which is initially cocked to a predetermined stress acts on the firing pin 82 such that at another predetermined depth the Belleville spring pops and fires the detonator 44.

In the device of U.S. Pat. No. 3,143,071, a detonator charge is carried within a pinion member 36 which is caused to rotate into an in-line position by rack members 50 and 51. Rack members 50 and 51 are caused to move under influence of outside pressure acting on piston 55. When aligned with a relay charge 52 and percussion primer 53, a further greater outside pressure causes a firing pin 17 to impinge on the percussion primer.

Use of outside ambient pressure to drive an out-of-line safe/arm device into an arm position is old as exemplified by the art. However, the combination of an out-of-line safe/arm device which is armed at a predetermined pressure and actuated at a greater predetermined pressure by means of a burst diaphragm, a portion of which impinges on a percussion primer has not been found in the Prior Art.

SUMMARY OF THE INVENTION

The invention comprises an out-of-line safe/arm device which maintains sensitive explosive elements in an out-of-line position until armed and fired by the pressures unique to the environment of the geothermal well. The device comprises a housing member having an axially extending bore therein, a slider bore in the housing member which extends transversely to the axially extending bore and a slider journeled in the slider bore. Both the axially extending bore and the slider bore are in open communication with the ambient pressure outside the housing member at any given time. A primer member is contained in the axially extending bore and is sealed off from outside pressure initially by means of a burst diaphragm which is coined such that upon bursting, a tab-like member is dependent from the remainder of the burst diaphragm and impinges upon the primer member. The slider carries a detonator which, under the influence of outside pressure, comes into alignment with the primer and an output lead member which is carried by the housing.

DESCRIPTION OF THE PREFERRED EMBODIMENT

Figure 1:
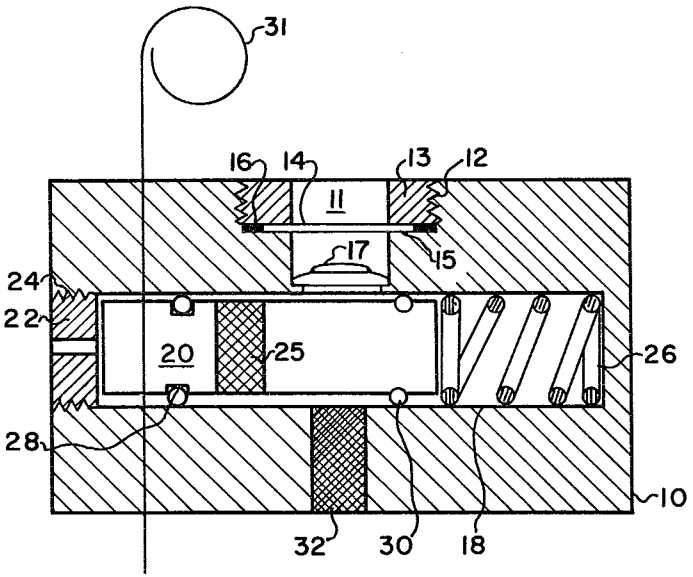
FIG. 1 is a partial showing in cross-section of the out-of-line safe/arm device of the present invention.

As shown in FIG. 1, a housing 10 is provided which contains axially extending bore 11 therein. The upper portion of the bore 11, as shown in FIG. 1 has an enlarged diameter and is threaded as at 12 to receive a plug 13. Plug 13 maintains a burst diaphragm 14 in engagement against a shoulder 15 of the bore 11. A seal 16 is provided at the outer perimeter of the burst diaphragm so that outside elements cannot come into contact with a percussion primer 17.

Percussion primer 17 is fixed in position at the bottom of the bore 11 as shown in FIG. 1. The distance between the burst diaphragm 14 and the top of the percussion primer 17 is such that upon bursting of the diaphragm 14, a tab-like portion thereof will come into contact with the uppermost portion of the percussion primer 17.

Bore 18 is also formed in housing 10 transverse to that of bore 11. Carried within bore 18 is a slider 20 which is held in position in bore 18 by means of another plug 22 threaded into a threaded portion 24 of bore 18. A detonator 25 is carried by the slider 20 and extends therethrough transversely of the slider.

Slider 20 is biased to an out-of-line position by means of a bias spring 26 which bears against one end of the slider 20 and the end of bore 18. Seals are provided around the slider 20 as at 28 and 30 to seal against outside elements, such as water, getting to the internal portion of the device. A safety pin 31 extends through a hole in the housing 10 and slider 20 to maintain the slider in the safe position.

An output lead 32 is carried in a cavity in the housing 10 such that in the armed position, percussion primer 17, detonator 25 and the output lead 32 are in axial alignment.

Figure 2:
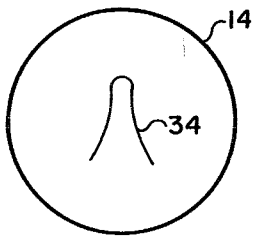
FIG. 2 is a plan view of one embodiment of the burst diaphragm.

The burst diaphragm 14 with coined impression 34 thereon is shown in FIG. 2. The thickness of the burst diaphragm and the depth of coining is predetermined such that the diaphragm will burst at a predetermined known pressure.

OPERATION

The out-of-line safe/arm mechanism was designed to initiate an explosive charge deep within a geothermal well. The mechanism provides a high degree of safety by maintaining the sensitive explosive elements (those containing "primary" explosives) in an out-of-line position. That is, inadvertant or spontaneous ignition of the primer 17 or the detonator 25 will not propagate to the output lead 32. The output lead 32 and all other explosive components in the main charge are much less sensitive secondary explosives.

The mechanism is armed after it is lowered into the well by pressure unique to the environment of the well at a particular depth. Therefore, during shipping, handling, storage, and assembly the degree of hazard is reduced to a level comparable to that of the main charge. Further, since the mechanism is self-actuating, that is, it fires at a predetermined pressure corresponding to the desired depth, no communication with the surface such as by electrical wires is required. If it is decided to abort the firing after the mechanism has armed, it will return to the safe position when the external pressure drops sufficiently. This will occur while the mechanism is still in the well on the way to the surface. Thus, any time the main charge would pose a threat to personnel, the mechanism is in the safe "out-of-line" position.

In FIG. 1, slider 20 is shown in the safe position, that is the detonator 25 is out of alignment with the percussion primer 17 and output lead 32. Thus, if the primer 17 were to initiate it would not set off the detonator 25. Also, if the detonator 25 were to fire it would not set off the next element, the output lead 32.

Safety pin 21 assures that the slider 20 remains in the safe position during handling, shipping, storage, and assembly. The safety pin 31 would be removed just prior to the entire charge being lowered into a well.

Slider 20 is maintained in the safe position after the removal of the safety pin 31 by bias spring 26. When the charge is lowered into the well, ambient pressure (less than that at the desired depth of initiation) pushes the slider to the right in FIG. 1, thereby compressing the bias spring 26 and trapped air in the cavity in bore 18. When the slider 20 is moved to the right, detonator 25 comes into alignment with the percussion primer 17 and output lead 32 thereby arming the mechansim.

Seals 16 and 28 prevent leakage of any fluid or other outside element into the mechanism while seal 30 prevents air trapped in the bore 18 from escaping. The seals are common O-ring seals and are well known in the art.

The pressure at the depth at which it is desired to fire percussion primer 17 is determined and a burst diaphragm with a rupture point corresponding to that pressure is installed in bore 11. This is done prior to assembling the device on the main charge which is used to stimulate the geothermal well.

The burst diaphragm 14 is a thin metal disc in which a coined shape 34 similar to that shown in FIG. 2 is stamped. Depth of coining and thickness of and type of material will determine at what differential pressure the device will rupture. Rupture points of burst diaphragms are accurate and quite repeatable.

The coined portion on the burst diaphragm is much like the pull-tab on a aluminum drink container. When it ruptures, the perforated tab moves inwardly with sufficient velocity so that it strikes the percussion primer 14 and initiates the primer. The primer 14 then fires detonator 25 and this in turn initiates the output lead 32. The explosive output from the output lead 32 is then transmitted via an explosive link (not shown) such as Primacord or mild detonating fuze to the main charge (also not shown).

The output of the safe/arm device could perform the function also of starting a gas generator or opening an explosive valve in a compressed gas cylinder before initiating the main charge. This would be done by inserting a pyrotechnic delay in that portion of the explosive train leading to the main charge. The exact explosive configuration from the output of this device to main charge will be determined by the final configuration of the stimulating charge. Alternatively, the present safe/arm device might be used for depth charges or in any environmental situation where a differential pressure external to the device at the desired point of function makes the use of such a mechanism practical and/or desirable.

What is claimed is:

1. An out-of-line safe/arm device which maintains a percussion primer member, detonator member and output lead member in a out-of-line position until armed by pressure comprising;

a housing member;

an axially extending bore in said housing member;

a slider bore in said housing member extending transversely to said axially extending bore;

both said axially extending bore and said slider bore being in open communication with existing pressure outside said housing member;

slider means contained within said slider bore and adapted for movement axially with respect thereto;

said primer member being contained in said axially extending bore;

diaphragm means in said axially extending bore and sealing said primer member from outside pressure;

said diaphragm means being designed to burst at a predetermined outside pressure and impinge on said primer member thereby causing said primer member to ignite.

2. An out-of-line safe/arm device as set forth in claim 1 wherein;

said detonator member is carried in said slider means;

said slider means functioning such that under outside pressure the slider is caused to move axially in said slider bore until said detonator member and percussive primer member are in alignment.

3. An out-of-line safe/arm device as set forth in claim 2 wherein;

said output lead member is contained within said housing member in axial alignment with said percussion primer member.

4. An out-of-line safe/arm device as set forth in either of claims 1 or 2 or 3 wherein;

said diaphragm means comprises a burst diaphragm which is designed so that upon bursting under the influence of outside pressure a tab-like member dependent at one end from said remainder of the burst diaphragm is produced which impacts on said percussion primer member.

5. An out-of-line safe/arm device as set forth in claim 4 and further including;

biasing means contained within said slider bore and acting on said slider remote from the portion of said slider in open communication with the outside atmosphere.

6. An out-of-line safe/arm device as set forth in claim 5 wherein;

said biasing means comprises a coil spring.

* * * * *